US008329013B2

(12) United States Patent
Brouwer et al.

(10) Patent No.: US 8,329,013 B2
(45) Date of Patent: Dec. 11, 2012

(54) OPTIMIZED ELECTROCOATING OF ASSEMBLED AND PARTLY PREPHOSPHATED COMPONENTS

(75) Inventors: Jan-Willem Brouwer, Willich (DE); Matthias Hamacher, Hurth (DE); Frank-Oliver Pilarek, Cologne (DE); Marc Balzer, Monheim (DE); Jens Kroemer, Duesseldorf (DE); Roland Popp, Manching (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 74 days.

(21) Appl. No.: 12/885,915

(22) Filed: Sep. 20, 2010

(65) Prior Publication Data

US 2011/0062027 A1 Mar. 17, 2011

Related U.S. Application Data

(63) Continuation of application No. PCT/EP2009/053065, filed on Mar. 16, 2009.

(30) Foreign Application Priority Data

Mar. 20, 2008 (DE) ..... 10 2008 015 390
Apr. 4, 2008 (DE) ..... 10 2008 017 523

(51) Int. Cl.
*C25D 13/12* (2006.01)
*C23C 22/78* (2006.01)

(52) U.S. Cl. ..... 204/487; 204/510; 148/254

(58) Field of Classification Search ..... 204/487, 204/510; 148/254
See application file for complete search history.

(56) References Cited

U.S. PATENT DOCUMENTS 4,165,242 A 8/1979 Kelly et al.
5,851,371 A 12/1998 Steinbrecher et al.
6,214,132 B1 4/2001 Nakayama et al.

FOREIGN PATENT DOCUMENTS

| | | | |
|---|---|---|---|
| DE | 19540085 | A1 | 4/1997 |
| EP | 0525870 | B1 | 9/1994 |
| EP | 0611810 | B1 | 10/1999 |
| EP | 0977908 | B1 | 9/2003 |
| EP | 1378586 | B1 | 2/2007 |
| EP | 1988189 | A1 | 11/2008 |
| WO | 0112341 | A1 | 2/2001 |
| WO | 2007021024 | A1 | 2/2007 |
| WO | 2007097139 | A1 | 8/2007 |

OTHER PUBLICATIONS

Sorkin, G.N.: "Possibility of activating a metal surface in a suspension of sludge from zinc phosphate baths", Chemical Abstracts, XP-002135088, American Chemical Society, U.S., vol. 96, No. 24, Jun. 14, 1982, p. 265.

Mizuno, H.: "Phosphate treatment of steel sheet and galvanized steel", Chemical Abstracts, XP-002135087, American Chemical Society, U.S., vol. 84, No. 22, May 31, 1976, p. 239.

International Search Report, International application PCT/EP2009/053065 dated Jun. 24, 2009.

*Primary Examiner* — Kishor Mayekar
(74) *Attorney, Agent, or Firm* — Mary K. Cameron

(57) ABSTRACT

A process for the anticorrosive treatment of metal components that have been heat-treated at a temperature of at least 100° C. and at least partially comprise zinc surfaces, wherein the surfaces of the component that consist of zinc already partially have a crystalline zinc phosphate layer, wherein the cleaned component is given an activating pretreatment with an acidic aqueous dispersion of insoluble phosphates having a pH of not less than 4 and the component is subsequently subjected to a phosphating conversion treatment before electrocoating is applied. The invention also comprises the use of metal components that have been treated in such a process, for the application of multilayer systems and in particular for the manufacture of bodies in automobile production.

22 Claims, No Drawings

OPTIMIZED ELECTROCOATING OF ASSEMBLED AND PARTLY PREPHOSPHATED COMPONENTS

CROSS-REFERENCE TO RELATED APPLICATIONS

This application is a continuation under 35 U.S.C. Sections 365(c) and 120 of International Application No. PCT/EP2009/053065, filed Mar. 16, 2009 and published on Sep. 24, 2009 as WO 2009/115485 A1, which claims priority from German Patent Application Serial No. 10 2008 015390.7 filed Mar. 20, 2008 and German Patent Application Serial No. 10 2008 017 523.4 filed Apr. 4, 2008, which are incorporated herein by reference in their entirety.

BACKGROUND OF THE INVENTION

The present invention relates to a method for anticorrosion phosphating and electro-dipcoating of components assembled from elements which are at least in part metallic, which consist in part of prephosphated zinc surfaces, in which the metallic elements of the component, which consist at least in part of prephosphated zinc surfaces, or the individual components have been subjected to heat treatment. This method overcomes the disadvantageous formation of irregularities during electro-dipcoating ("mapping") of the phosphated component by means of an activating pretreatment with an acidic aqueous dispersion containing insoluble phosphates.

Various metallic materials and product forms are used in body construction in the automotive industry and in the manufacture of individual parts, for example doors. Some of these must be cut to size, shaped and then assembled to form the desired component. The materials and product forms used for this purpose are in the main "bright" metals, the surfaces of which do not comprise a coating which offers sufficient protection from corrosion or is suitable for the application of a coating system. Such "bright" surfaces also include, in addition to the actual metal surfaces, those which are provided with anticorrosion oils merely for transport or storage. Steel strip manufacturers, however, also supply prephosphated materials which can be immediately dipcoated on the particular OEM's premises before further coating layers are applied. The materials cut to size, shaped and assembled into the corresponding component for the production of an unfinished body accordingly not only comprise various metal surfaces but also have some surfaces which already comprise an initial passivation (phosphating) which provides protection from corrosion. One major material which is of significance in automotive production is here in particular prephosphated, galvanized steel strip, which is an essential component of the unfinished body and in component manufacture, for example of doors. When assembling the individual materials to form the finished component, the sheet metal parts are frequently joined not only by spot welding but also by continuous welding or clinching. Other methods such as riveting (e.g. for aluminum/steel joints) and adhesive bonding are increasingly frequently being used to assist welded joints, with adhesive bonding in particular becoming increasingly significant as the sole materially bonded joining method. Especially with adhesive joints, heat treatment of the elements preassembled to form the component is at present essential in order to ensure a durable adhesive bond between the individual elements ("pregelling"). During this "pregelling" of the applied adhesives, the prephosphated surfaces of the component are exposed to elevated temperatures which permanently modify the chemical and physical characteristics of the phosphate layer, in particular of a zinc phosphate layer. The modified properties of the heat-treated prephosphated components then have an impact on the subsequent anticorrosion treatment and specifically on electro-dipcoating. It is, for example, observed that electro-dipcoating on the prephosphated surfaces results in different coating layer weights than on those surfaces which were not subjected to phosphating until they reached the OEM's premises. These differences in the quality of dipcoating, which are visible on the assembled and heat-treated component, are coating defects and are described as "edge mapping". This "mapping" also has an effect on further top coating layers which are applied, meaning that the non-uniform appearance still remains visible once the complete coating structure has been applied. If the assembled and heat-treated component also comprising prephosphated surfaces is phosphated by spraying, the "mapping" after electro-dipcoating is also particularly apparent in the form of "curtaining", which reproduces the initial wetting pattern, typical of spraying, of the prephosphated areas with the phosphating solution.

The problem of "mapping" is thus a current problem in particular in automotive manufacture and has not previously been adequately addressed and handled in the prior art.

EP 0977908 accordingly discloses an activating pretreatment solution for metallic surfaces prior to zinc phosphating which contains (a) ammonium and/or alkali metal salts, which preferably constitute phosphates, (b) dispersed phosphates of di- and/or trivalent metal cations and (c) microparticulate oxides for stabilizing the dispersion.

According to the teaching of EP 0977908, the dispersion can be used over a wide pH range from 4 to 13, the particularly preferred pH range for maximally effective activation of the metal surfaces being between 7.5 and 8.5. A person skilled in the art cannot, however, infer from this disclosure any teaching as to avoiding "mapping" on heat-treated prephosphated areas of metallic components in subsequent electro-dipcoating.

BRIEF SUMMARY OF THE INVENTION

The object of the present invention is accordingly to suppress the occurrence of irregularities in electro-dipcoating ("mapping") on anticorrosion treatment of components assembled from metallic elements which at least in part also consist of prephosphated zinc surfaces and which have been subjected to heat treatment.

DETAILED DESCRIPTION OF THE INVENTION

It has surprisingly been possible to show that this object may be achieved by a method in which the metallic component, which has been heat-treated at a temperature of at least 100° C. and which consists at least in part of surfaces of zinc, the surfaces of the component which consist of zinc in part comprising a crystalline zinc phosphate layer, is subjected in successive individual steps to anticorrosion treatment comprising:

(A) optional cleaning and degreasing of the component;

(B) activating pretreatment with an acidic aqueous dispersion containing insoluble phosphates with or without an intermediate rinsing step, the pH value of the dispersion being no less than 4;

(C) phosphating conversion treatment of the activated component, such that at least on all the ferrous and zinc surfaces of the component there is in each case present a crystalline zinc phosphate layer with a layer weight of no less than 0.5 $g/m^2$; and (D) electro-dipcoating of the component with or without an intermediate rinsing step.

In particular, a method according to the invention is used to treat such a metallic component which consists in part of surfaces of zinc with a crystalline zinc phosphate layer and which has been heat-treated at a temperature of at least 100° C., particularly preferably of at least 150° C.

In the method according to the invention, a metallic component is in particular taken to mean assembled elements, the component being in part assembled from such elements which have surfaces of zinc, not bright zinc surfaces, but crystalline layer coatings of zinc phosphate, at least these elements having been heat-treated at a temperature of at least 100° C., particularly preferably of at least 150° C.

Heat treatment at a temperature of at least 100° C. of the individual elements of the component, which also constitute surfaces of zinc already comprising a crystalline phosphate layer, here preferably proceeds according to the invention at the earliest immediately before assembly of the metallic component from the individual elements. Heat treatment of the elements immediately before assembly of the elements to form the component serves to improve the adhesive bond after application of the adhesive onto the corresponding areas of the metallic elements to be joined. Such heat-induced "pregelling" of the adhesive is always necessary, such that assembly of the elements provided with the adhesive to form the finished component can proceed in practice as soon as possible after heat treatment.

Heat treatment of the elements of the component, which also constitute surfaces of zinc already comprising a crystalline phosphate layer, has preferably been performed for at least 5 min, particularly preferably at least 15 min at a temperature of at least 100° C. If the temperature is below 100° C. or if the duration of heat treatment is distinctly shorter, it is not to be anticipated that "mapping" will occur as a result of irregular electro-dipcoating of the assembled component. Conversely, such unwanted "mapping" is particularly severe in the case of a processing sequence for anticorrosion phosphating which is not according to the invention with subsequent electro-dipcoating of components whose individual elements have previously been heat-treated at temperatures of at least 150° C.

The metallic component may here consist of elements of zinc, iron and aluminum and the alloys thereof, preferably of steel and alloy-galvanized steel, the elements used according to the invention always being those whose zinc surface at least in part comprises a crystalline phosphate layer. Such prephosphated elements of zinc or zinc surfaces according to the invention preferably have an elemental loading of the crystalline phosphate layer of no less than 0.5 $g/m^2$, particularly preferably of no less than 1 $g/m^2$.

Cleaning and degreasing of the component in step (A) preferably proceeds in a surfactant-containing, alkaline aqueous solution by spraying or dipping. Dipping is here preferred as it exerts lower mechanical shear forces on the prephosphated areas of the component. Acidic cleaning solutions corrode the prephosphated zinc surfaces of the component and so produce coating defects which must additionally be healed in the following process steps according to the invention to ensure ideal corrosion protection. Acidic cleaning thus however increases the irregularity of the phosphated surfaces of the component. Cleaning is conventionally carried out at elevated temperature, preferably at temperatures of above of 40° C. and a pH value of no less than 8, particularly preferably of no less than 9.

Activating pretreatment in method step (B) proceeds at a pH value of no less than 4, the pH value being, however, preferably no greater than 6, particularly preferably no greater than 5.5 and particularly preferably no greater than 5. If activation is performed in a dispersion, the pH value of which is below 4, the prephosphated zinc surfaces of the component are increasingly corroded and dispersed zinc phosphate particles, which activate the metallic surfaces of the component, begin to pass completely into solution in the aqueous phase, such that not only are already corrosion-protected areas of the component spoiled but activation itself is made ineffective. Conversely, it has been possible to show that activation solutions, the pH values of which are above 6, immediately effect phosphating of the component in step (C) of a nature which gives rise to irregular electro-dipcoating and, as the pH value increases, to a distinct increase in surface areas with a non-uniform appearance ("mapping"). Optimum results in terms of uniform electro-dipcoating over the entire surface and thus a virtually complete avoidance of "mapping" are achieved in the particularly preferred pH range of 4 to 5.

The dispersions in step (B) are preferably dispersions of insoluble phosphates of the metals zinc, iron, manganese, nickel, cobalt, calcium, magnesium and/or aluminum, preferably zinc and/or iron and particularly preferably zinc.

For the purposes of the present invention, insoluble phosphate is that proportion of the phosphate salt required for preparing the aqueous dispersion which does not pass into solution in the aqueous phase at the pH value of the acidic dispersion according to the invention. In principle, in the acidic dispersions according to the invention in step (B), the dissolved ionogenic components of the phosphate salt are at chemical equilibrium with its particulate insoluble component, in other words with the insoluble phosphate. The acidic aqueous dispersions thus always comprise saturated solutions of the phosphate salts used selected from phosphates of zinc, iron, manganese, nickel, cobalt, calcium and/or aluminum. In such saturated dispersions according to the invention, insoluble phosphate has a diameter of at least 0.05 μm.

The acidic aqueous dispersion in step (B) preferably contains the insoluble phosphate in an average particle diameter of no more than 5 μm, particularly preferably of no more than 2 μm. The average particle diameter in the acidic aqueous dispersion is determined by light scattering methods, such that not only individual particles but also agglomerates of individual particles are detected. According to the invention, the particle diameter accordingly relates both to discrete phosphate particles and to agglomerates thereof.

It has in particular been found that activation of the metallic surfaces of the component in step (B) proceeds effectively for subsequent phosphating in step (C), namely resulting in the formation of a homogeneous, continuous and finely crystalline zinc phosphate layer, when the content of insoluble phosphates in the acidic aqueous dispersion in step (B) with a particle diameter of no more than 5 μm amounts to at least 0.1 g/l relative to $PO_4$. Larger particles or agglomerates containing insoluble phosphate bring about virtually no adequate activation of the metallic surfaces for the subsequent zinc phosphating. In addition to maintaining an acidic pH value of no less than 4, good activation is, however, crucial for preventing "mapping" in the subsequent electro-dipcoating in step (D) of the method according to the invention. It is consequently important to maintain this preferred minimum proportion of insoluble phosphate with a particle diameter of no more than 5 μm in the acidic aqueous dispersion during step (B). Conversely, it has been found that very high proportions of insoluble phosphate of above 20 g/l neither effect any further improvement in terms of activation nor do they suppress any further the occurrence of "mapping" during electro-dipcoating in step (D).

The addition of water-soluble phosphates to the acidic aqueous dispersion in step (B) has an additional positive effect on the suppression of "mapping" and is therefore likewise preferred. In particular, the content of water-soluble phosphates relative to the total quantity of dissolved $PO_4$ amounts to no less than 1 g/l, preferably no less than 2 g/l, particularly preferably no less than 4 g/l. "Mapping" in the subsequent electro-dipcoating of the phosphated component is completely suppressed at this preferred content of soluble phosphate. On the other hand, the presence of soluble phosphates is not observed to have a significant effect on "mapping" below a soluble phosphate content of 1 g/l. Very high contents of water-soluble phosphates of more than 100 g/l may, in particular in the case of low contents of insoluble phosphates, result, on the one hand, in "ripening" of the phosphate particles of the dispersion due to the shift in the saturation equilibrium so shifting their average particle size to higher values and, on the other hand, the dispersion becomes overall less stable due to the elevated ionic strength which is then present. Such high contents of water-soluble phosphates should therefore preferably be avoided. Water-soluble phosphate is defined according to the invention as the total proportion of phosphates dissolved in the acidic aqueous dispersion relative to $PO_4$.

The content of water-soluble phosphates is preferably adjusted by means of such phosphate salts which, in an acidic aqueous dispersion of the method according to the invention, completely pass into solution and so dissociate into their ionogenic components. The alkali metal and ammonium salts of phosphoric acid and/or phosphoric acid itself have proved particularly suitable for this purpose. A soluble phosphate content may also be adjusted starting from an aqueous dispersion of insoluble phosphate by the addition of acids with a pKa value of less than 5 in order to establish the pH value according to the invention of the acidic aqueous dispersion. In so doing, a proportion of the insoluble particulate phosphate passes into solution. One disadvantage of this method of adjusting the soluble phosphate content is the irreversible modification of the particle size distribution, since it is primarily the particularly small scale proportion of phosphate particles which is dissolved. In practice, it is therefore preferred to add phosphate-buffered solutions to adjust the soluble phosphate content and the pH value according to the invention. The proportions of water-soluble phosphates and insoluble phosphate in the acidic aqueous dispersion according to step (B) of the method according to the invention may be determined by the ultrafiltration method. Two volumes of identical size of the dispersion are first of all taken for this purpose. In the first volume, the proportion of soluble phosphates relative to $PO_4$ is determined analytically in the ultrafiltration filtrate with a pore exclusion limit of 0.05 μm, while the total content of dissolved phosphate relative to $PO_4$ is determined in the second volume. The difference in phosphate content in the two identical volumes then gives rise to the proportion of insoluble phosphate relative to $PO_4$ in the acidic aqueous dispersion.

The stability of the acidic aqueous dispersion according to step (B) of the method according to the invention may be increased by an additional proportion of insoluble particulate oxides, such that the addition thereof is preferred in one particular embodiment of the basic method. The additional proportion of particulate oxides can extend the stability of the acidic dispersion to a shelf life of several months, without agglomeration proceeding to such an extent that the insoluble phosphates settle out. The insoluble particulate oxides are here preferably selected from one or more oxides of silicon, iron, zirconium and/or titanium. Such oxides are sufficiently acid-stable and are thus capable of exerting their stabilizing action as a particulate component in the acidic aqueous dispersion.

The proportion of particulate oxides required for additional stabilization of the acidic aqueous dispersion against agglomeration is preferably at least 1 ppm, particularly preferably at least 10 ppm, with contents of above 500 ppm in the acidic dispersions bringing no additional benefit with the preferred proportion of insoluble phosphates. It is advantageous for ideal stabilization of the insoluble phosphates for the particulate oxides to have a particle diameter of no more than 0.5 μm, in particular of no more than 0.1 μm. It is here important for the average particle size of the insoluble phosphates preferably at least to be larger than that of the particulate oxides. The average particle diameter of the particulate oxides should be measured by light scattering methods in the absence of the insoluble phosphates in an aqueous solution with a pH value according to the invention. Oxide particles may be deposited onto the phosphate particles in acidic aqueous dispersions which additionally contain insoluble particulate oxide. These agglomerates consisting of both phosphate particles and oxide particles do not, however, lose their activating action for the subsequent phosphating in step (B) until these agglomerates have a size of distinctly greater than 5 μm. Agglomerates of phosphate particles and oxide particles are accordingly deemed according to the invention to be insoluble phosphate, the content of which with a particle size of below 5 μm preferably amounts to at least 0.1 g/l relative to $PO_4$.

The phosphating baths for phosphating conversion treatment known to a person skilled in the art may be used in step (C), provided that they are suitable for the deposition of a crystalline zinc phosphate layer at least on the uncovered ferrous and zinc surfaces of the component. According to the invention, ferrous surfaces include surfaces of steel, while zinc surfaces also include, in addition to galvanized steel surfaces, surfaces of alloy-galvanized steel and zinc alloy.

The phosphating solutions which should preferably be used are those which can be applied by spraying or dipping and which contain 0.2 to 3 g/l of zinc ions and 3 to 50 g/l of phosphate ions, the weight ratio of phosphate ions to zinc ions amounting to at least 3.7, as well as one or more accelerators selected from

- 0.3 to 4 g/l of chlorate ions,
- 0.01 to 0.2 g/l of nitrite ions,
- 0.05 to 2 g/l of m-nitrobenzenesulfonate ions,
- 0.05 to 2 g/l of m-nitrobenzoate ions,
- 0.05 to 2 g/l of p-nitrophenol,
- 0.005 to 0.15 g/l of hydrogen peroxide in free or bound form,
- 0.1 to 10 g/l of hydroxylamine in free, ionic or bound form,
- 0.1 to 10 g/l of a reducing sugar
- 0.05 to 4 g/l of an organic N-oxide, preferably N-methylmorpholine,
- 0.5 to 5 g/l of an organic nitro compound selected from nitroguanidine, nitroarginine and methyl, ethyl or propyl esters thereof and from nitrofurfurylidene diacetate.

The dipcoatings known in detail to a person skilled in the art may be used for the electro-dipcoating in step (D).

A passivating post-treatment may optionally be interposed between method steps (C) and (D), which post-treatment on the one hand heals defects in the phosphating and, on the other hand, should in particular be used if step (C) does not result in homogeneous, continuous phosphating of the aluminum surface of the component with a layer weight of at least 0.5 g/m$^2$ of zinc phosphate. The passivating post-treatment of the component after phosphating in step (C) and before electro-dipcoating in step (D) is preferably carried out by means of an acidic composition containing fluoro complexes of the metals Zr and/or Ti, the proportion of fluoro complexes relative to the elements Zr and/or Ti particularly preferably being in the range from 50-1000 ppm.

A further aspect of the present invention relates to the use of a metallic component, which has been treated in accordance with the method according to the invention for avoiding "mapping", in a process for the application of a multilayer system, preferably consisting of organic coating materials, in industrial surface finishing.

Metallic components treated according to the present invention are furthermore used in the construction industry and architectural sector, and for the production of vehicle bodies in automotive manufacture and for the production of "white goods" and electronic housings.

Exemplary Embodiment

A typical processing sequence for anticorrosion treatment of metallic components of the type provided by the present invention consists of the following process steps.

Method A:

1) Degreasing in Ridoline 1565® (Henkel AG & Co. KGaA) by dipping
   Formulation: 3.0% Ridoline® 1565 A and 0.3% Ridosol® 1270 in tap water
   pH value: 10.8
   Temperature: 56-57° C.
   Duration: 5-6 min
2) Rinsing with deionized water
   Temperature: RT
   Duration: 1-2 min
3) Activation with acidic aqueous dispersions by dipping
   Formulation: 0.14 g/l of insoluble phosphate measured as $PO_4$ 4.9 g/l of soluble phosphate measured as $PO_4$ produced by addition of a solution of 27.4% of $H_3PO_4$ and 10.4% of NaOH in deionized water (pH 2.9) to a dispersion of 0.6 g/l of $Zn_3(PO_4)_2.4H_2O$ in deionized water until a pH value of 4.3 is established.
   Temperature: RT
   Duration: 30 s
4) Phosphating with Granodine® 952 (Henkel AG & Co. KGaA) by spraying
   Formulation: Granodine® 958 A+Toner® C 16+Toner® 338
   Free acid: 1.6 points at pH 3.6
   Total acid: 22.0-23.0 points at pH 8.5
   $Zn^{2+}$: 1.1 g/l
   Free fluoride: 120-145 mg/l
   Accelerator: 1.8-2.0 gas points
   Spray pressure: 0.7 bar
   Temperature: 51° C.
   Duration: 3 min
5) Rinsing with deionized water
   Temperature: RT
   Duration: 30 s
6) Drying with compressed air
7) Coating with cathodic dipcoat, CathoGuard® 500 (BASF AG) and stoving of the coating material at 175° C. for 25 min in an oven.

Method B:

A conventional activation solution (Fixodine® 158×, Henkel AG & Co. KGaA) is used as a comparative example which comprises a dispersion of $Zn_3(PO_4)_2.4H_2O$ (average particle diameter 2.0-2.2 measured with model DTS 5100 Malvern Zetasizer) with a proportion of zinc phosphate of 0.15 g/l relative to $PO_4$, the proportion of soluble phosphates being predetermined by the solubility product of the zinc phosphate and a pH value of 8.5 prevailing.

"Prespray" in the phosphating zone during vehicle body manufacture was simulated by syringing a few drops of phosphating solution after activation onto prephosphated galvanized sheet steel (ZE, prephosphated) and phosphating by spraying after an exposure time of approx. 20 s. "Mapping" occurred in the form of "curtaining" due to initial wetting with the phosphating solution in the case of a conventional activating pretreatment with Fixodine® at a pH value of 8.5.

It is apparent from Table 1 that activation with an acidic aqueous dispersion containing insoluble and soluble phosphate in the method (A) according to the invention is capable of suppressing "mapping" effects.

TABLE 1

Occurrence of "mapping" on heat-treated prephosphated ZE sheet metal as a function of the particular activating pretreatment method

| Sheet metal | Method | Layer weight* in g/m$^2$ | Mapping# |
|---|---|---|---|
| Steel (CRS) | A | 1.4 | — |
| | B | 1.7 | — |
| ZE, prephosphated | A | 1.5-1.7 | no curtaining/marks |
| | B | 1.5-1.7 | curtaining/marks clearly evident |

*Layer weight of zinc phosphating

#"Mapping" in the form of optical differences ("curtaining") and irregularities in subsequent dipcoating ("edge mapping")

It is additionally clear that the film thickness of the dipcoat (CathoGuard®) is thinner at those points at which "mapping" occurs than in the other areas. On cross-sections, which were prepared by microtome, it was possible determine on prephosphated ZE sheet metal, which was treated according to method (B) and on which marks in the form of curtaining were consequently present, that the average film thickness after 5-fold measurement was 20.6 μm, while that away from the marks was 24.7 μm. Layer thicknesses were determined by measuring the microtome cross-sections by scanning electron microscopy.

What is claimed is:

1. A method for anticorrosion treatment of metallic components, in which the metallic component comprising in part surfaces of zinc which comprise crystalline coating layers of zinc phosphate has been heat-treated at a temperature of at least 100° C., the heat-treated component then passes in succession through the following steps:

(A) optional cleaning and/or degreasing of the component, (B) activating pretreatment of the component with an acidic aqueous dispersion containing insoluble phosphates, said dispersion having a pH value of no less than 4, (C) phosphating conversion treatment of the component, such that at least on all the zinc surfaces, and any ferrous surfaces if present, of the component there is in each case present a crystalline zinc phosphate layer with a layer weight of no less than 0.5 g/m$^2$; and (D) electro-dipcoating of the component.

2. The method as claimed in claim 1, wherein the metallic component comprises assembled elements, which have in part surfaces of zinc which comprise crystalline layer coatings of zinc phosphate, the elements having been heat-treated at a temperature of at least 100° C.

3. The method as claimed in claim 1, wherein cleaning of the component in step (A) is effected with an alkaline solution whose pH value is no less than 8.

4. The method as claimed in claim 1, wherein the pH value of the acidic aqueous dispersion in step (B) is no greater than 6.

5. The method as claimed in claim 1, wherein the insoluble phosphates in step (B) are selected from phosphates of zinc, iron, manganese, nickel, cobalt, calcium, magnesium and/or aluminum.

6. The method as claimed in claim 1, wherein average particle diameter of the insoluble phosphates in the acidic aqueous dispersion in step (B) is no greater than 5 μm.

7. The method as claimed in claim 6, wherein content of the insoluble phosphates in the acidic aqueous dispersion in step (B) with a particle diameter of no more than 5 μm amounts to at least 0.1 g/l relative to $PO_4$.

8. The method as claimed in claim 1, wherein the acidic aqueous dispersion in step (B) additionally contains water-soluble phosphates.

9. The method as claimed in claim 8, wherein content of water-soluble phosphates relative to total quantity of dissolved $PO_4$ is no less than 1 g/l.

10. The method according to claim 8, wherein alkali metal salts of phosphoric acid, ammonium salts of phosphoric acid and/or phosphoric acid are present as water-soluble phosphates.

11. The method as claimed in claim 8, wherein content of water-soluble phosphates relative to total quantity of dissolved $PO_4$ is no less than 4 g/l.

12. The method as claimed in claim 1, wherein the acidic aqueous dispersion in step (B) additionally contains insoluble particulate oxides.

13. The method as claimed in claim 12, wherein the insoluble particulate oxides are selected from one or more oxides of silicon, iron, zirconium and/or titanium.

14. The method as claimed in claim 12, wherein content of the insoluble particulate oxide amounts to at least 1 ppm.

15. The method as claimed in claim 12, wherein content of the insoluble particulate oxide amounts to at least 10 ppm and does not exceed 500 ppm.

16. The method as claimed in claim 12, wherein the acidic aqueous dispersion in step (B) additionally contains water-soluble phosphates in an amount relative to total quantity of dissolved $PO_4$ of no less than 1 g/l and content of the insoluble particulate oxide amounts to at least 10 ppm.

17. The method as claimed in claim 1, wherein the metallic component has been heat-treated at a temperature of at least 150° C.

18. The method as claimed in claim 1, wherein a passivating post-treatment of the component with an acidic composition comprising fluoro complexes of Zr and/or Ti, is interposed between (C) and (D).

19. The method as claimed in claim 1, wherein the pH value of the acidic aqueous dispersion in step (B) is no greater than 5.

20. The method as claimed in claim 1, wherein the insoluble phosphates in step (B) are selected from phosphates of zinc and/or iron.

21. The method as claimed in claim 1, wherein content of the insoluble phosphates in the acidic aqueous dispersion in step (B) with a particle diameter of no more than 5 μm amounts to at least 0.1 g/l relative to $PO_4$.

22. The method as claimed in claim 1, wherein the insoluble phosphates of the acidic aqueous dispersion in step (B) have an average particle diameter of at least 0.05 μm and no greater than 5 μm.

* * * * *